US005269427A

United States Patent [19]

Hurd

[11] Patent Number: 5,269,427

[45] Date of Patent: Dec. 14, 1993

[54] CONTAINER

[75] Inventor: Frederick E. Hurd, Toronto, Canada

[73] Assignee: In-Flo Liquid Dispensing Corporation, Toronto, Canada

[21] Appl. No.: 829,047

[22] PCT Filed: Aug. 10, 1990

[86] PCT No.: PCT/CA90/00256

§ 371 Date: Feb. 10, 1992

§ 102(e) Date: Feb. 10, 1992

[87] PCT Pub. No.: WO91/01921

PCT Pub. Date: Feb. 21, 1991

[30] Foreign Application Priority Data

Aug. 10, 1989 [CA] Canada ..... 6080219

[51] Int. Cl.[5] ..... B65D 1/42; B65B 43/42

[52] U.S. Cl. ..... 215/31; 215/1 C

[58] Field of Search ..... 215/1 C, 31, 235, 237; 220/771, 756, 751, 671, 669, 675; 53/300, 367

[56] References Cited

U.S. PATENT DOCUMENTS

| | | | |
|---|---|---|---|
| 1,833,971 | 12/1931 | Lloyd | 215/31 |
| 2,045,388 | 6/1936 | Guthrie | 215/31 X |
| 2,059,910 | 11/1936 | Ravenscroft | 215/31 |
| 2,135,330 | 11/1938 | Desser | 215/31 |
| 3,064,844 | 11/1962 | Hoffmann | 215/31 |
| 3,432,989 | 3/1969 | Bouzereau | 53/300 |
| 3,857,506 | 12/1974 | Hafele | 215/31 |
| 3,957,168 | 5/1976 | Shine et al. | 215/31 X |
| 4,653,676 | 3/1987 | Stull | 53/367 X |
| 4,815,256 | 3/1989 | Brown et al. | 53/300 X |
| 4,949,861 | 8/1990 | Cochran | 215/31 X |

FOREIGN PATENT DOCUMENTS

| | | | |
|---|---|---|---|
| 934745 | 11/1955 | Fed. Rep. of Germany . | |
| 1244653 | 9/1971 | United Kingdom | 215/31 |

*Primary Examiner*—Horace M. Culver
*Attorney, Agent, or Firm*—Patrick J. Hofbauer

[57] ABSTRACT

The present invention relates to a container having at least one indexing flat arranged along a neck portion thereof, and adapted to be received in register with corresponding portions of, for example manufacturing, handling and dispensing devices adapted for selectively positioning the container in predetermined radial alignment relative thereto during production; handling; distribution; or filling of the container.

4 Claims, 4 Drawing Sheets

CONTAINER

TECHNICAL FIELD

The present invention concerns improvements relating to, inter alia, liquid dispensing systems, and especially to systems for dispensing liquids from bulk liquid supplies on a demand basis an to a dispensing apparatus.

BACKGROUND OF ART

In highly competitive mass merchandising of products, particularly at the retail level, there is an ever more pressing need to optimize merchandising efficiency.

In the case of certain liquid products, (such as for example automobile windshield washer anti-freeze, oil and the like, or comestibles such as milk), that are retailed in relatively large volumes in consumer-sized packaging through a retail outlet, storage, logistics and retail space problems tend to increase a retailers operating costs.

An alternative approach to merchandising such goods is to provide in-store dispensing of such liquids from a bulk supply thereof. Manual dispensing must be carried out either by the purchaser or by retail store personnel. Customer service conscious retailers do not tend to view dispensing by the purchaser as a particularly attractive form of retailing. Health, safety, portion control and other considerations may also adversely relate to this approach to dispensing products. Retail store personnel are not generally cost effective when employed in the role of dispenser operators.

Accordingly, even though considerable savings and possibly other benefits might accrue to a retailer through its securing a bulk supply of a product to be dispensed in consumer-sized retail quantities in the retail outlet, the additional cost, complexity and other liabilities of this approach to dispensing such goods generally makes its adoption commercially untenable.

Vending machine technologies for automating the dispensing of products provides a partial solution to some of the problems facing retailers of the products in question, but in general are not readily adaptable to a wide range of products and do not provide the benefits of on site dispensing of bulk products.

One machine which is intended to secure at least some of the benefits sought through automated bulk dispensing of flowable, and especially liquid, products, is disclosed in U.S. Pat. No. 4,815,256.

One of the difficulties in implementing the above mentioned technologies lies in ensuring that containers used therein are properly oriented during the various automated handling, etc, thereof. The difficultly lies in arranging for the necessary alignment, one aspect of which is related to appropriate radial alignment. This is of particular importance in the handling of containers which are either physically or functionally asymmetrical.

U.S. Pat. No. 4,120,134 discloses an apparatus for filling flexible containers which are fed to the apparatus as a continuous web arranged in such a way as to provide for predetermined alignment of succeeding containers at a filling station. The respective neck portions of the containers support annular rings which are adapted to be received between the mutually opposed edges of two inwardly extending flanges of a gripping device having an opening with a complimentary profile. The gripping device then receives the annular ring supporting portion of the containers neck, and mechanically orients the opening in the neck with a filler spout on the apparatus.

U.S. Pat. No. 3,242,951 discloses a web-feeding filler apparatus filler head, adapted to receive a specially shaped cap secured to the neck of the container to be filled. Peripheral edges of the cap a cut away, so as to engage in a plowing relationship with shaped portions of the filling head. This arrangement is intended to orient the container in a predetermined relation to the filling head during the filling process, but requires that a particular cap shape be employed, which is both relatively costly and limiting from a marketing point of view.

DISCLOSURE OF INVENTION

The present invention relates to a container having at least one flat arranged along a neck portion thereof and first and second annular tabs arranged in encircling relation around said neck portion in opposed encircling relation to one another across said at least one flat. The tabs and at least one flat are adapted to be received in register with corresponding portions of mechanical means for selectively positioning the container in predetermined radial and axial alignment relative thereto during mechanical handling operations thereof. Such operations include any one or more of the operations selected from the group consisting of production; distribution; or, filling, of the container. With this arrangement, the container will be positioned in a specific radial and axial orientation relative to the handling means. This facilitates handling of asymmetrical containers such as, for example, containers where the neck is offset to one side thereof or containers having grasping means which must be specifically positioned relative to a dispensing spout.

In one embodiment of the invention, the container comprises at least two flats arranged on diametrically opposed side of the neck portions. The neck portion includes at least two axially spaced apart annular tabs arranged opposite one another across the abovementioned flats. Preferably, the first annular tab is arranged along the neck at an axial location immediately below a proximal edge of a closure adapted to be secured to the neck, and this tab is at least radially coextensive with the closure when the closure is so secured. The second annular tab preferably comprises a raised portion of a shoulder of the container.

The present invention includes a method of handling a container substantially as described hereinbefore, comprising the steps of engaging the flats in secured register with the corresponding means and selectively positioning the container in a predetermined radial and axial alignment relative thereto.

In this connection, there is provided, by way of example, a method of manufacturing the containers, wherein a parison is blow molded to form the container, which is then removed from a blow molder by engaging the flats in secured register with molded bottle transfer means for selectively positioning the container in predetermined radial alignment relative thereto. Blow molding techniques, per se, are generally well known in the plastics fabricating arts. A general overview is set out in "PLASTICS", DuBois et al, Van Nostrand Reinhold Company, 1967. According to this text blow molding takes one of a least two basic approaches: injection blow molding; and, extrusion blow molding. The latter is the most widely commercially used method, and includes both rising mold and parison transfer methods. Parison programming is used in known manner to control wall thickness of various portions of the containers walls and neck, etc.

In any case, once the molded container is positioned in predetermined radial alignment relative to the bottle transfer means, it is, if required, transferred to a flash removal station in predetermined radial alignment at the station to align flash lines on the bottle with flash removing means. For this purpose the flats are preferably located in radially spaced apart relation from flash lines extending along the neck portion, so as to provide clear access to the flash lines for the flash removing means.

In connection with the present invention there is also provided methods of using the above described containers in dispensing operations, and particularly for machine dispensing a discrete quantity of bulk liquid into such a container, comprising the steps of:

mechanically selecting one such container from a plurality of such containers, mechanically positioning the selected container with the at least one indexing flat secured in register with corresponding portions of means for selectively positioning the container in predetermined radially indexed alignment in filling position, mechanically introducing a metered quantity of the bulk liquid into the container, mechanically delivering the container of liquid to a dispensing access of the machine.

In connection with another aspect of the invention there is provided a method wherein the flats are engaged in secured register with labeling means and selectively positioned in predetermined radial alignment relative thereto to thereby locate predetermined surfaces of the container in predetermined register with means for applying labeling indicia thereon.

The containers hereinbefore described are particularly useful in conjunction with a container distribution and dispensing magazine, which broadly speaking in relation to another aspect of the present invention comprises: an elongated magazine clip adapted to receive a plurality of containers for collective distribution and handling thereof, in supported, interfitting, releasably slidable relation with respective waisted portions thereof, and operable to direct delivery of succeeding ones of the containers longitudinally along the magazine to an at least one discharge opening therefrom, the clip including at least two walls each including respective dependant transverse faces arranged in mutually opposed relation across an elongated opening therebetween, along which opening the waisted portions of the containers are releasably slidably arranged between the transverse faces.

Preferably the magazine comprises an elongated magazine clip defining a partially enclosed interior between a back wall with two mutually opposed side walls depending from opposite edges of the back wall and supporting respective partial front walls in spaced apart relation from the back wall, the front walls each including respective dependant transverse faces arranged in mutually opposed relation across an elongated opening that is defined between the faces and which opens into the interior, along which opening the waisted portions of the containers are releasably slidably arranged between the transverse faces.

Preferably the waisted portions of the containers comprise neck portions thereof and particularly neck portions which include indexing flats thereon, adapted to be positionable in register with the transverse faces to orient the container in predetermined relation to the magazine. In an especially preferred form, the magazine of the present invention is adapted to secure containers as set forth hereinabove along at least two indexing flats arranged on diametrically opposed sides of the neck portions. Moreover, the magazine is preferably adapted to secure neck portions which include an at least one annular tab, for which purpose the front walls of the magazine clip are adapted to engage the annular tab in abutting relation therewith, to secure against withdrawal of the container from the clip through the elongated opening between the transverse faces. In one aspect where the containers neck portions include at least two axially spaced apart annular tabs arranged opposite one another across the flats, the respective portions of the front walls adjacent the transverse faces thereof are adapted to engage corresponding ones of the at least two annular tabs in abutting relation therewith, to further secure the container against movement through the elongated opening defined between the transverse faces.

In an especially preferred embodiment the clip is adapted to receive a closure bearing end of the container in shielded relation within the partially enclosed interior. This arrangement holds potential sanitary benefits. Moreover, with the closures thus shielded, they are more likely to remain in a predetermined radial orientation relative to the secured container.

Typically the clip includes at least one open end from which the containers can be dispensed from the clip, but through which passage of at least a portion of the containers is precluded by restraining means removably secured to the clip, such as adhesive tape, for example.

In use the magazine includes a plurality of containers with respective waisted portions thereof secured in supported, interfitting, releasably slidable relation with the clip.

In a preferred form of the clip of the present invention the transverse faces each include at least one raised rib extending longitudinally along the faces, which ribs are adapted to abut against the waisted portions in contacting relation therewith, to thereby reduce the amount of mutually contacting frictional surface area between the transverse face of the clip and the container. This facilitates migration of the succeeding ones of the containers during their respective longitudinal traverse of the clip towards the dispensing opening arranged therein.

Such magazines find application in connection with various methods, including, for example, a method for distributing containers having respective waisted portions, comprising the steps of, securing a plurality of the containers in mutually transportable relation with dispensing means adapted to secure the containers in interfering relation about the waisted portions thereof, and transporting the plurality of containers together with the means, in the mutually secured relation. In one aspect of this method the dispensing containers having respective waisted portions, and the method comprises the steps of, releasing succeeding ones of a plurality of the containers releasably secured in sequentially dispensable relation from distribution means adapted to secure respective ones of the containers in interfering relation about the waisted portions thereof.

In another aspect there is provided a method of machine dispensing a discrete quantity of a bulk liquid into succeeding ones of containers having respective waisted portions, comprising the steps of:

mechanically selecting one such container from a discharge opening of an at least one magazine comprising an elongated magazine clip adapted to receive a plurality of the containers for collective distribution and handling thereof, in supported, interfitting, releasably slidable relation with respective waisted portions thereof, and operable to direct delivery of succeeding ones of the containers longitudinally along the magazine to an at least one discharge opening therefrom, the clip including at least two walls each including respective dependant transverse faces arranged in mutually opposed relation across an elongated opening therebetween, along which opening the waisted portions of the containers are releasably slidably arranged between the transverse faces, mechanically positioning the selected container in a predetermined filling position, mechanically introducing a metered quantity of the bulk liquid into the container, mechanically delivering the container to a dispensing access of the machine.

The magazines of the present invention are also useful in dispensing apparatus: an example of one such apparatus is that set forth in U.S. Pat. No. 4,815,256. Accordingly there is provided a container filling and dispensing apparatus for use with a plurality of containers each having a mouth of generally circular cross-section providing access to the interior of the container and a closure having a generally annular rim portion adapted for encircling fixation around the mouth of the container and a hinged portion attached to the rim portion so as to be positionable over the mouth for closing of the container, the apparatus comprising:

magazine means for receiving the plurality of containers in oriented stacked relation therein and comprising an elongated magazine clip adapted to receive a plurality of containers for collective distribution and handling thereof, in supported, interfitting, releasably slidable relation with respective waisted portions thereof, and operable to direct delivery of succeeding ones of the containers longitudinally along the magazine to an at least one discharge opening therefrom, the clip defining a partially enclosed interior between a back wall with two mutually opposed side walls depending from opposite edges of the back wall and supporting respective partial front walls in spaced apart relation from the back wall, the front walls each including respective dependant transverse faces arranged in mutually opposed relation across an elongated opening that is defined between the faces and which opens into the interior, along which opening the waisted portions of the containers are releasably slidably arranged between the transverse faces.;

opening means for opening the closure of the selected container;

container positioning means for locating selected ones of said stacked containers to a predetermined operative filling position with the rim portion in a predetermined indexed orientation relative to the opening means;

liquid dispensing means for dispensing a metered quantity of a bulk liquid through the mouth into the interior of said selected container at said filling position;

closing means for closing the closure of the selected container in sealing relation with the mouth; and, means to deliver the selected container to a dispensing access of the apparatus.

Such an apparatus is preferably adapted for use with a plurality of containers each having at least two flats arranged on diametrically opposed sides of the neck portions thereof, and adapted to be received in slidable contacting register between the transverse faces. The container positioning means includes means for engaging the container along the flats for fully withdrawing the container from the magazine into suspended relation and for positioning the container in predetermined radial alignment at the operative filling position.

The apparatus may be adapted to accommodate containers having closures thereon, including in particular, but only by way of example, a closure such as that described in connection with U.S. Pat. No. 4,815,256 and else where herein, wherein the rim portion of closure has a pressure-sensitive area adapted to facilitate initial opening of the hinged lid potion upon the application thereto of a radially inwardly directed compressive force of threshold magnitude, and wherein an abutment means is provided adjacent the filling position to contact the pressure-sensitive area upon said relocation thereby to apply such a compressive force to the pressure sensitive area.

In such an apparatus as is described herein, the magazine means may comprise a plurality of magazine clips arranged in generally parallel, spaced apart relation.

Containers of the present invention can also be used to advantage in conjunction with modified closures having indexing means thereon and in particular, closures comprising an upper, radially symmetrical surface with a contiguous skirt portion depending therefrom, and indexing means arranged along the surface and offset from the surfaces axis of radial symmetry, which indexing means is adapted to be received in register with corresponding portions of means for selectively positioning the closure in predetermined radial alignment relative thereto during handling operations selected from one or more of the group consisting of handling in general and more specifically installation of the closure.

Preferably the closure indexing means comprises an upstanding elongated rib having a pair of mutually opposed sides, the rib being adapted to engage the means for selectively positioning the closure along at least a portion of one of the sides of the rib, to thereby rotate the closure into a position of predetermined radial alignment relative to the means for selectively positioning it. As set forth elsewhere herein in further detail, the closure is preferably a hinged closure and one having an annular rim portion and a hinged lid portion, which is operable in response to radial compression of a pressure sensitive area of the rim portion so as to initially open the hinged lid portion to an open condition, and thereafter, applying an opening force against the operative underside of the lid portion to thereby displace the hinged lid portion of the closure through a predetermined rotation to affect an operative degree of opening thereof.

By way of an example of the use of the container and the closure in combination, there is provided a method for securing a container having indexing means including at least one flat arranged along a neck portion thereof with a corresponding closure having radial indexing means, the method comprising the steps of, positioning the radial indexing means in register with the closure application station, engaging the flats in secured register with the closure application station, selectively positioning the closure and the neck portion in axially superimposed register and predetermined mutually radially aligned correlation at the closure application station, engaging the closure in secured mutually radially aligned relation on the container.

In one aspect of the last above described method, the closure and the bottle are adapted to be mutually secured in interfering, frictional engagement, and the closure is preferably a snap-on closure.

BEST MODE(S) FOR CARRYING OUT THE INVENTION AND INDUSTRIAL APPLICABILITY

Figure 1:
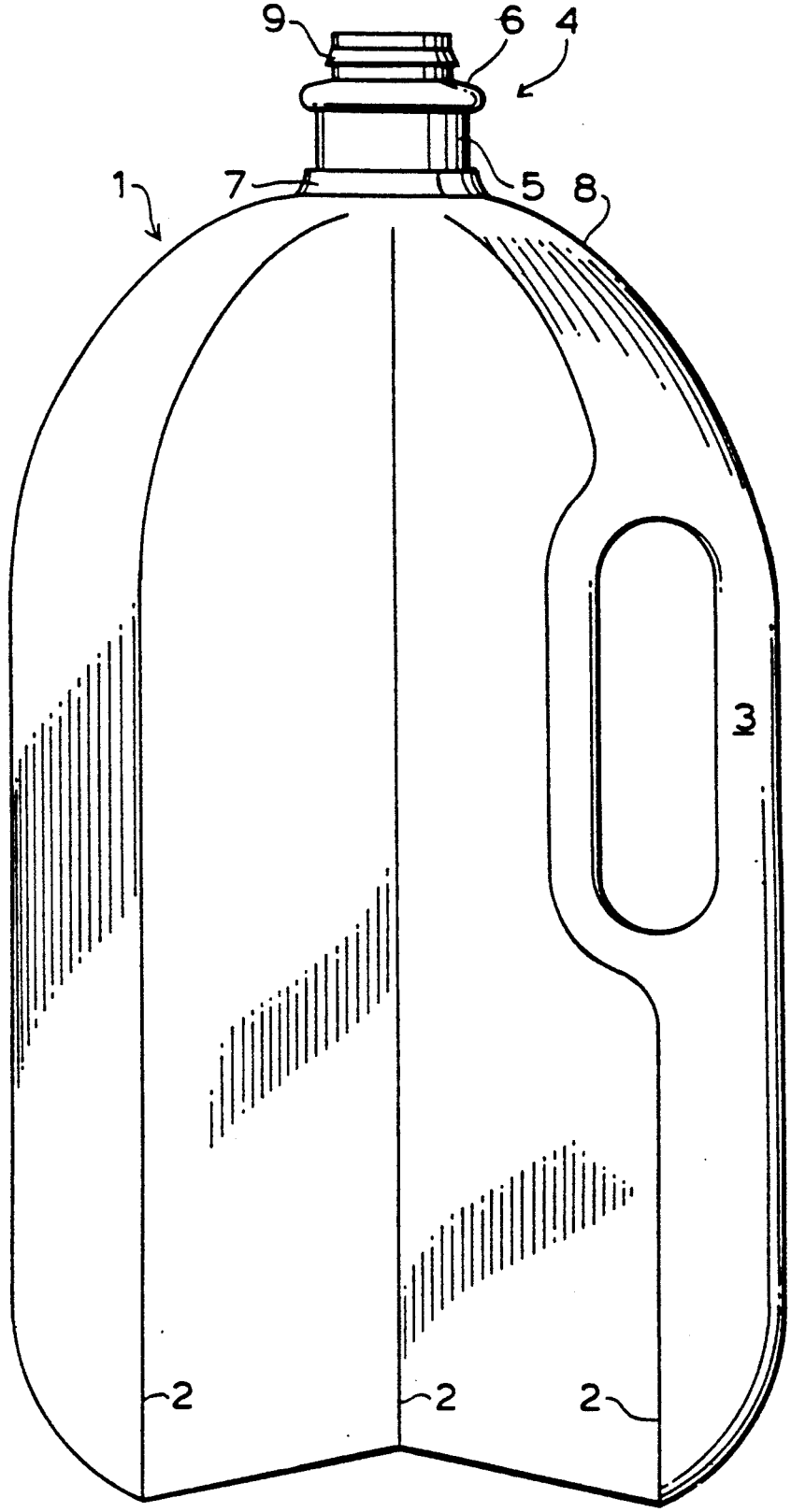
FIG. 1 of the drawings appended hereto is an elevated side view of a container of the present invention, and in particular of a collapsible-bodied bottle having a pair of mutually opposed indexing flats arranged along a neck portion thereof.

Referring now to FIG. 1 of the drawings, there is shown a container of the present invention comprising a bottle 1, having a collapsible body manufactured from thin plastics material and being collapsible for storage or transport purposes, along hinge lines 2 integrally formed along side walls thereof. Bottle 1 also includes grasping means in the form of an integrally formed handle 3. Neck portion 4 of the bottle includes indexing means comprising at least one flat 5 arranged along neck portion 4. Although only one flat is visible in the perspective of FIG. 1, bottle 1 actually includes two such flats which are arranged on diametrically opposed sides of said neck portions and are adapted to be received in register with corresponding portions of means for selectively positioning said container in predetermined radial alignment relative thereto during handling operations thereof.

Neck portion 4 includes further indexing means comprising two annular tabs, 6 and 7, adapted to be secured in register with corresponding portions of means for selectively positioning the container in predetermined axial alignment thereto. Annular tabs 6 and 7 are axially spaced apart from one another across said flats.

Tab 7 comprises a raised portion of shoulder 8 of bottle 1.

Tab 6 is arranged along neck portion 4 at an axial location immediately below a point where a lower proximal edge of a closure, (not shown in this figure) is adapted to be positioned with the closure secured to the neck portion 4 in snap-on interfitting relation on annular rib 9. Tab 6 is sized to be at least generally radially coextensive with the closure when the closure is so secured.

In this embodiment, flat 5 and the corresponding mutually opposed flat (not visible in this perspective) not only provide radial indexing surfaces, but also increase the available amount of surface along mutually opposed surfaces, (e.g. adjacent flat 5), of annuli 6 and 7 that can be engaged by means for axially securing the bottle.

Figure 2:
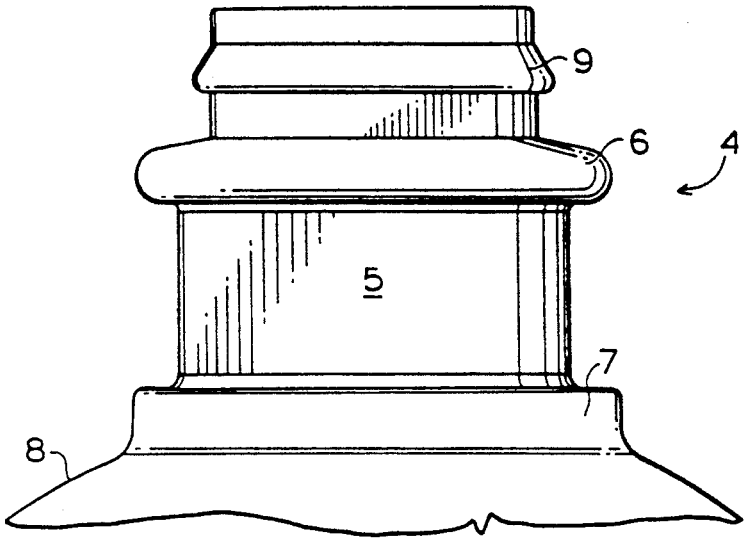
FIG. 2 of the drawings illustrates an enlarged view of the neck region of the bottle depicted in FIG. 1, showing one of the indexing flats in elevated side view.

FIG. 2 of the drawings depicts the neck portion 4 in greater detail.

Figure 3:
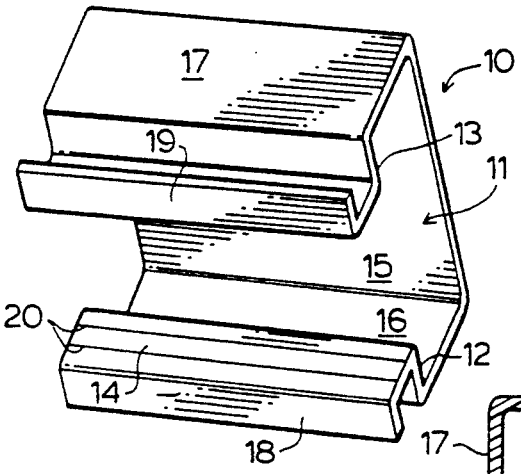
FIG. 3 of the drawings depicts a portion of an elongated magazine clip, depicted in perspective view, and illustrating a portion of the elongated opening therein opening into the interior of the clip.

Referring now to FIG. 3 of the drawings, there is shown a portion of an elongated magazine clip 10, adapted to receive a plurality of containers, not shown, for collective distribution and handling thereof, in supported, interfitting, releasably slidable relation with respective waisted portions thereof. Clip 10 is operable to direct delivery of succeeding ones of said containers longitudinally along said magazine to an at least one discharge opening therefrom, in this case an open end indicated by reference numeral 11. The opening is securable with adhesive tape to prevent bottles from leaving the clip prematurely.

Clip 10 includes two walls, 12 and 13, each including respective dependant transverse faces, of which only one, 14, is visible in this perspective. These transverse faces are arranged in mutually opposed relation across an elongated opening therebetween, along which opening said waisted portions of said containers are adapted to be releasably slidably arranged between said transverse faces.

Clip 10 defines a partially enclosed interior between a back wall 15 with two mutually opposed side walls 16 and 17 depending from opposite edges of the back wall 15 and supporting respective partial front walls 12 and 13 in spaced apart relation from the back wall.

Figure 4:
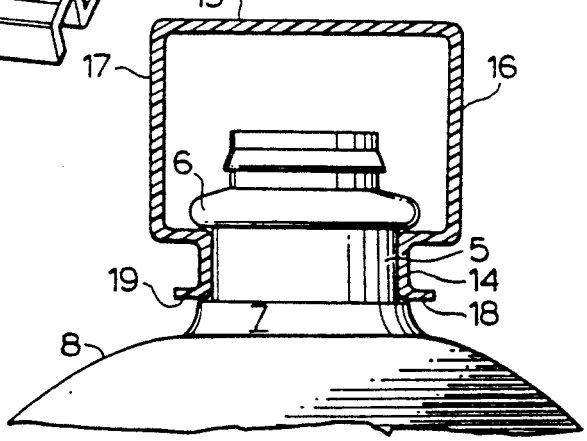
FIG. 4 of the drawings shows the bottle of FIG. 1 positioned, sans closure, with the neck portion thereof located interiorly of the magazine clip depicted in FIG. 3.

Clip 10 is particularly well adapted to engage waisted neck portions of such containers, and in particular the indexing means of the bottle shown in FIGS. 1 and 2 of the drawings appended hereto. Indexing flats 5 thereon, are adapted to be positionable in register with said transverse faces (e.g. 14) to orient the bottle in predetermined relation to said magazine. Front walls 12 and 13 are adapted to engage annular tabs 6 and 7 in abutting relation therewith along portions of the walls (including respective recursive portions 18 and 19) in order to secure against withdrawal of said bottle from said clip through said elongated opening between said transverse faces. This relationship is depicted in FIG. 4 of the drawings, which shows the neck portion of the bottle of FIG. 1 located in situ within the interior of clip 10.

Transverse faces (e.g. 14) each include a pair of raised ribs 20, extending longitudinally along the faces, which ribs are adapted to abut against said waisted portions in contacting relation therewith, to thereby reduce the amount of mutually contacting frictional surface area between the transverse face of said clip and said container. This arrangement facilitates bottle movement along the length of the clip 10.

Figure 5:
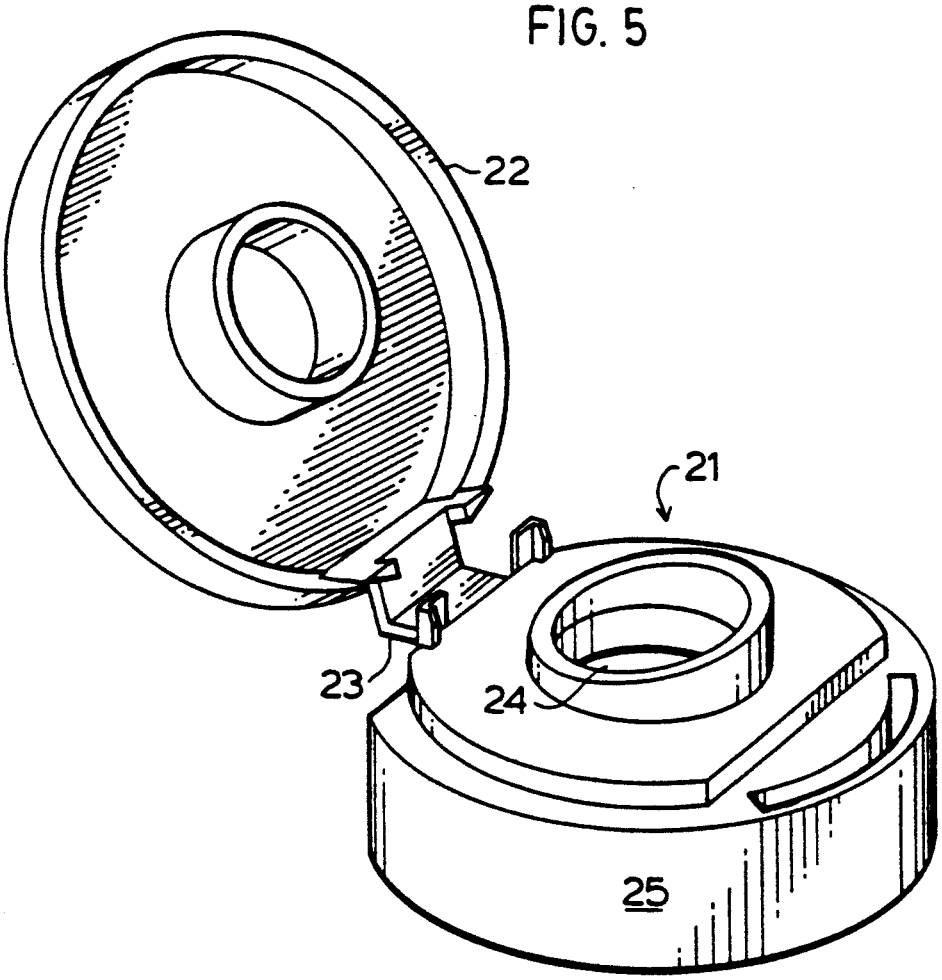
FIG. 5 of the drawings depicts a hinged closure member useful in conjunction with the bottle depicted in FIG. 1, as well as in conjunction with various of the methods set forth elsewhere herein.

Referring now to FIG. 5 of the drawings there is shown a closure 21 useful in conjunction with various aspects of the present invention. Closure 21 includes a hinged lid portion 22 adapted to articulate about an integrally formed hinge 23, generally between opened and closed positions, (closure 21 is depicted in the generally open position in which the closure 21 is adapted to pass materials through opening 24 therein. Closure 21 is adapted to be secured to bottle 1 shown in FIG. 1, in interfering relation with an annular rib 9, substantially as hereinbefore described. Such closures are generally available from Polytop Corporation, Slatersville, R.I., USA.. Such closures have a pressure-sensitive area indicated generally by reference numeral 25, which is adapted to facilitate initial opening of the hinged lid potion upon the application thereto of a radially inwardly directed compressive force of threshold magnitude.

Figure 6:
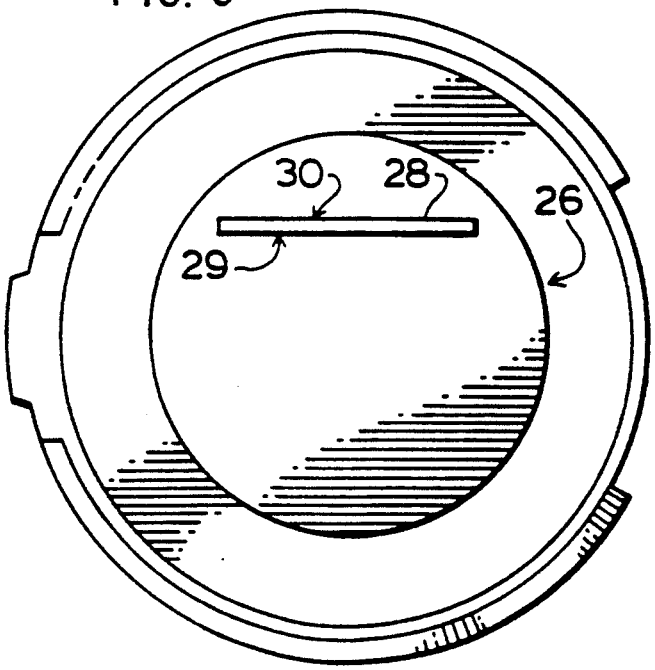
FIGS. 6 and 7 of the drawings show the same closure with a modified upper surface including an upstanding rib for radial indexing thereof.
Figure 7:
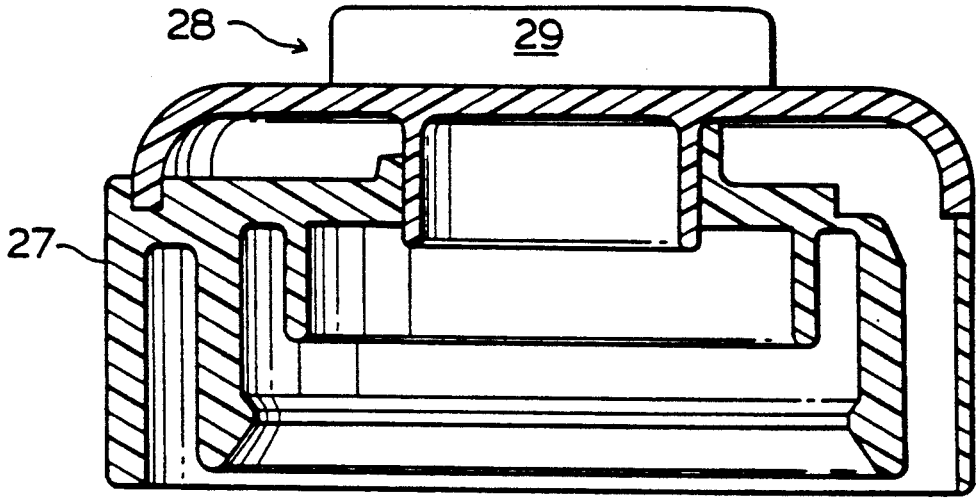

In accordance with a preferred embodiment of one aspect of the present invention, however, there is provided a modified closure, as depicted in top plan and elevated side crossectional views, respectively, in FIGS. 6 and 7 of the drawings. The preferred closure comprises an upper, radially symmetrical surface 26 with a contiguous skirt portion 27 depending therefrom, and indexing means arranged along said surface and offset from said surfaces axis of radial symmetry. The indexing means is adapted to be received in register with corresponding portions of means for selectively positioning said closure in predetermined radial alignment relative thereto during handling operations both in general and more particularly those selected from one or more of the group consisting of production or, installation, of said closure. The indexing means comprises an upstanding elongated rib 28 having a pair of mutually opposed sides 29 and 30. The rib 28 is adapted to engage said means for selectively positioning said closure along at least a portion of one of the sides 29 or 30 of rib 28, to thereby rotate said closure into a position of predetermined radial alignment relative to said means for selectively positioning. The preferred closure 21 is substantially otherwise as depicted in FIG. 5, being a hinged closure having an annular rim portion 27 and a hinged lid portion bearing upper surface 26, and being operable in response to radial compression of a pressure sensitive area of said rim portion so as to initially open the hinged lid portion to an open condition, and thereafter, applying an opening force against the operative underside of said lid portion to thereby displace the hinged lid portion of said closure through a predetermined rotation to affect an operative degree of opening thereof.

The embodiments of the invention in which an exclusive property or privilege is claimed are defined as follows:

1. A container having indexing means comprising at least one flat arranged along a neck portion thereof and a first annular tab arranged in encircling relation around said neck portion, both of said at least one flat and said first annular tab being adapted to be received in register with corresponding portions of mechanical means for selectively positioning said container in predetermined radial alignment relative thereto during mechanical handling operations thereof, characterized by the neck portion having a second annular tab positioned on the neck portion in opposed encircling relation to said first annular tab across said at least one flat, said second annular tab being adapted to be received in register with respective corresponding portions of said mechanical means for simultaneously positioning said container in predetermined, axial alignment relative to said mechanical means.

2. The container according to claim 1, wherein said indexing means is comprised of at least two flats arranged on diametrically opposed sides of said neck portion.

3. The container according to claim 2, wherein one of said first and second annular tabs comprises a raised portion of a shoulder of said container.

4. The container according to claim 3, wherein the other of said first and second annular tabs is arranged along said neck at an axial location immediately below a proximal edge of a closure adapted to be secured to said neck when said closure is so secured, and said other tab is at least generally radially coextensive with said closure when said closure is so secured.

* * * * *